US006352772B1

(12) United States Patent
Keller

(10) Patent No.: US 6,352,772 B1
(45) Date of Patent: Mar. 5, 2002

(54) PAPERMAKING BELTS COMPRISING STRIATED MONOFILAMENTS

(75) Inventor: Robert Allen Keller, Columbia, SC (US)

(73) Assignee: Shakespeare, Columbia, SC (US)

( * ) Notice: Subject to any disclaimer, the term of this patent is extended or adjusted under 35 U.S.C. 154(b) by 0 days.

(21) Appl. No.: 09/378,512

(22) Filed: Aug. 20, 1999

Related U.S. Application Data

(62) Division of application No. 08/125,524, filed on Sep. 22, 1993, now Pat. No. 5,985,450.

(51) Int. Cl.[7] ..... D02G 3/00

(52) U.S. Cl. ..... 428/364; 428/374; 428/373; 428/397

(58) Field of Search ..... 428/200, 286, 428/287, 288, 289, 293, 302, 317, 229, 401, 397, 399, 400, 224

(56) References Cited

U.S. PATENT DOCUMENTS

| | | | | |
|---|---|---|---|---|
| 3,164,947 A | * | 1/1965 | Gaston | |
| 3,478,389 A | | 11/1969 | Bradley, et al. | |
| 3,691,749 A | | 9/1972 | McKay | |
| RE29,363 E | | 8/1977 | McKay Re | |
| 4,154,886 A | * | 5/1979 | Yamazaki et al. | 428/200 |
| 4,251,588 A | | 2/1981 | Goetemann et al. | |
| 4,370,375 A | | 1/1983 | Bond | |
| 4,370,378 A | * | 1/1983 | Bond | 428/229 |
| 4,417,031 A | | 11/1983 | Aharoni et al. | |
| 4,639,397 A | * | 1/1987 | Sato et al. | 428/397 |
| 4,661,406 A | | 4/1987 | Gruh et al. | |
| 5,069,970 A | * | 12/1991 | Largman et al. | 428/373 |
| 5,141,811 A | * | 8/1992 | Kawakami et al. | 428/364 |
| 5,162,152 A | | 11/1992 | Rashbrook | |

FOREIGN PATENT DOCUMENTS

| | | |
|---|---|---|
| GB | 2024776 | 12/1993 |

* cited by examiner

*Primary Examiner*—Merrick Dixon
(74) *Attorney, Agent, or Firm*—Huntley & Associates

(57) ABSTRACT

Polymeric monofilaments having 3 to 12 circumferential striations exhibit excellent performance when used in woven papermaking belts.

22 Claims, 1 Drawing Sheet

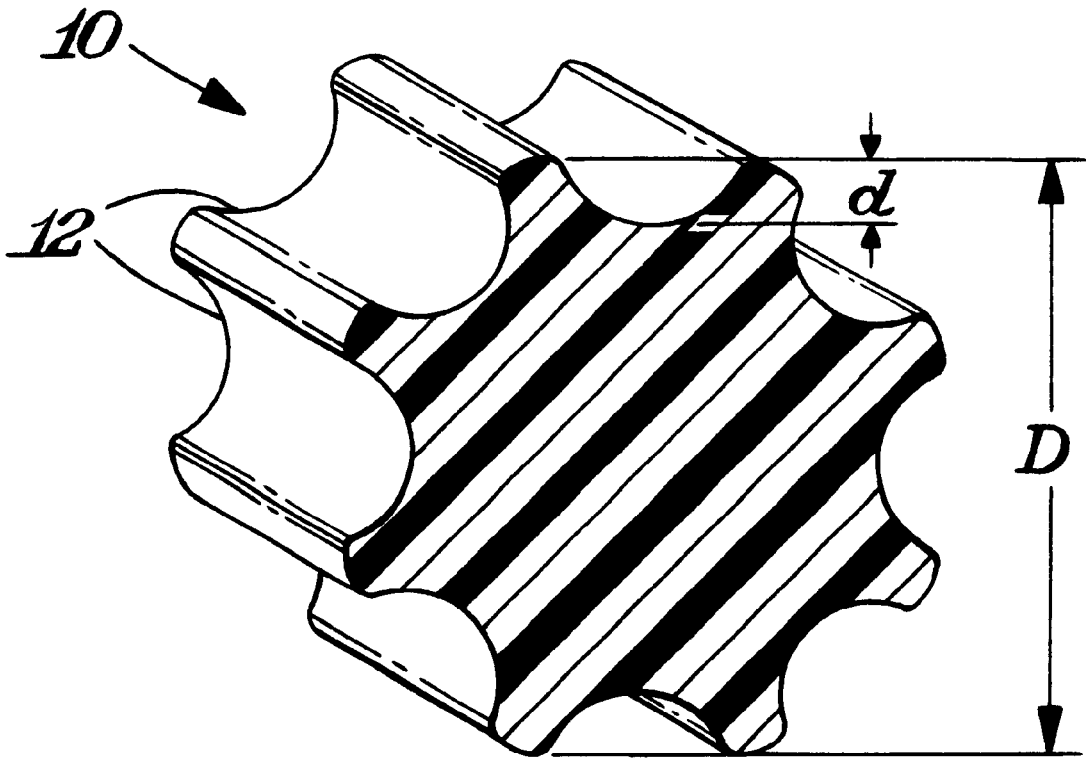
10
12
d
D

PAPERMAKING BELTS COMPRISING STRIATED MONOFILAMENTS

This application is a division of application Ser. No.08/125,524, filed Sep. 22, 1993, now U.S. Pat. No. 5,985,450.

BACKGROUND OF THE INVENTION

In the preparation of paper, woven support belts are used for the initial casting, transporting and dewatering of the paper sheet. These belts are known as paper machine clothing. A variety of materials have been used in manufacture of such belts, including metals, and, currently, thermoplastic monofilaments. Thermoplastic materials which have been used in the weaving of these belts include nylon, polyphenylene sulfide (PPS), and poly ether ether ketone (PEEK), as well as polyester monofilaments. The requirements for the monofilaments in the machine and cross machine directions in paper machine clothing often vary. Accordingly, filaments which differ in polymeric composition, size, configuration and filler materials are often used in the machine and cross machine direction. While monofilaments are normally round in cross-sectional configuration, many other shapes have been used in attempts to balance the requirements of strength, durability, abrasion resistance and overall performance in the paper machine clothing.

SUMMARY OF THE INVENTION

The present invention provides polymeric monofilaments, particularly useful in paper machine clothing, which exhibit improved wettability and wet abrasion resistance.

Specifically, the instant invention provides an oriented polymeric monofilament having a diameter of about from 4 to 60 mils and having a cross-sectional configuration characterized by 3 to 12 striations on the circumference, each striation having a depth of about from 4 to 20% of the diameter of the monofilament.

The instant invention further provides, in a woven papermaking belt of machine and transverse direction thermoplastic filaments, the improvement wherein at least about 20% of filaments in at least one of the machine and cross machine directions are monofilaments having a diameter of about from 4 to 60 mils and having a cross-sectional configuration characterized by 3 to 12 striations on the circumference, each striation having a depth of about from 4 to 20% of the diameter of the monofilament.

BRIEF DESCRIPTION OF THE DRAWING

The FIGURE is a cross-sectional perspective illustration of a monofilament of the present invention.

DETAILED DESCRIPTION OF THE INVENTION

The filaments of the present invention can be prepared from a wide variety of polymeric materials. Polyesters which can be used include polyethylene terephthalate, polybutylene terephthalate, and poly (cyclohexanedimethylene terephthalate/isophthalate) (PCTA). Polyamides which can be used include cyclic, aromatic, alaphatic, and copolymers of polyamides of fiber-forming molecular weight having a relative viscosity generally between 25 and 270 as determined by ASTM D-789. These polyamides include, for example, poly(caprolactam) (nylon 6), cyclic polyamides, poly(lundecanoamide) (nylon 11), poly(hexamethylene adipamide) (nylon 66), poly(hexamethylene decanoamide) (nylon 610), and poly(hexamethylene dodecanoamide) (nylon 612). Polyamide copolymers and polymer blends can also be used, such as those prepared from nylon 6 and nylon 66, and nylon 11. Of these polyamides, nylon 66, nylon 610 and nylon 6 have been found to be particularly satisfactory for use in paper machine clothing. For those applications that involve high temperature applications, polyphenylene sulfide (PPS), PCTA, and PEEK are preferred.

The monofilaments of the present invention have a cross-sectional configuration characterized by 3 to 12 striations on their circumference, and preferably 5 to 10 striations. These striations of a depth of about from 4 to 20% of the diameter of the filament, and preferably about from 8 to 15%. The diameter of the monofilaments is about from 4 to 60 mils, and preferably about from 6 to 30 mils.

The monofilaments are illustrated by the representation shown in the FIGURE. There, the monofilament 10 having diameter D, has eight striations 12, each of which has a depth d which is about 12% of the diameter. The monofilaments can be formed through a die orifice, characterized by multiple circumferential indentations of the same number and substantially the same configuration as the striations desired in the monofilament. Specifically, under typical extrusion conditions for a polyamide monofilament, for a striation in the finished monofilament having the required depth, the height of the indentations in the circumference should similarly be about from 4 to 20% of the diameter of the monofilament.

The polymeric material is extruded through the die and subsequently processed according to customary techniques. The molten polymer, blended with any desired additives, is extruded through the die into a quench medium, typically water, after which it is oriented. The monofilaments should be oriented by drawing about from 3.4 to 7.0 times their original length, and preferably about from 3.5 to 4.7 times their original length. The drawing is generally carried out in two stages but not limited to two stages. The diameter of the final monofilament is as noted above, and is measured from crest to crest in the striations.

The monofilaments of the present invention can be woven into papermaking belts according to conventional weaving techniques. The type and density of the weave will, of course, depend on the type of paper and papermaking operation for which the belt is to be used. The present monofilaments can be used in either or both of the machine and cross-machine directions in the woven belt. In general, to realize the benefits of the present invention, the monofilaments of the present invention should comprise at least about 20%, and preferably about from 50% to 100%, of either or both of the machine and cross machine direction strands. If the striated monofilaments of the present invention are used for only one direction in the weave of the papermaking belts, the weave pattern will dictate whether the cross machine direction (CMD) or machine direction (MD) yarns will give the greatest advantage of the improved abrasion resistance.

After weaving, the papermaking belts are often heat set according to conventional techniques to stabilize the weave. Typical heat setting conditions will vary with the polymer, filaments, diameter and weave, but will typically involve heating under tension in a hot air oven or on oil heated cylinders for a residence time of about from 5 to 15 minutes at a temperature of about from 300° F. to 400° F.

The monofilaments for the present invention exhibit improved resistance to sandpaper abrasion when compared to the same size round cross-sectional monofilament, particularly when wet.

The present invention is further illustrated by the following specific examples and comparative examples.

EXAMPLES 1 TO 3 AND COMPARATIVE EXAMPLE A

In Examples 1 to 3, polyethlene terephthalate was melt extruded through a die at a radius of 0.0219 inches and having 8 internal indentations, each having a radius of 0.0042 inch. The filaments were extruded at a temperature of 550°–580° F. and quenched in water maintained at a temperature of 140–145° F. The filaments were then oriented by drawing in two stages to 4.25 times their original length. The oriented monofilament had a diameter of about 11 mils and the cross-sectional configuration was characterized by 8 striations, the striations having a depth of about 0.7 mils. In Comparative Example A, the procedures were repeated, except that a round extrusion die was used, resulting in a filament with a round cross-sectional configuration.

The filaments were evaluated according to standard procedures for physical properties as well as configuration. The results are summarized in the Table, in which the parenthetical numbers represent the standard deviation in the measurements taken. The first measurement of diameter was calculated from the denier of the filament, while the second diameter was determined by measurement using a hand micrometer. The elongation is reported in percent, with tenacity and initial modulus reported in grams per denier (gpd). The filaments from the Examples and Comparative Examples were also tested for shrinkage, loop strength, tensile and modulus characteristics, and the striated filaments of the present invention and the round filament of Comparative Example A were found to be substantially equivalent in these tests.

The samples were tested for sandpaper abrasion in dry and wet environments. The samples were also tested by placing a weighted filament around rotating a metal cage for squirrel cage abrasion resistance.

As can be seen in the data in the table, and as is typical of filaments of this type, the round filaments represented by Comparative Example A show a depreciation in sandpaper abrasion when in a wet environment. By contrast, the striated monofilaments of the present invention, in a wet environment, exhibit sandpaper abrasion resistance that is substantially equal to or superior to the performance in the dry environment.

If the filaments of these examples are woven into a papermaking belt, so that the present filaments comprise 20% of the machine or cross machine direction filaments, the belts prepared from the filaments Examples 1–3 will exhibit superior abrasion resistance in the wet environment to those of Comparative Example A.

| EXAMPLE PROPERTY | A | 1 | 2 | 3 |
|---|---|---|---|---|
| Diameter (calc.), mils | 10.85 (.04) | 10.01 (.18) | 11.37 (.10) | 12.72 (.11) |
| Diameter (msmt.), mils | 10.7 (.07) | 10.0 (.19) | 11.7 (.15) | 12.6 (.14) |
| Out-of-Roundness, mils | .20 (.06) | .42 (.12) | .44 (.20) | .65 (.11) |
| Denier | 741.6 (4.76) | 631.6 (22.33) | 814.8 (14.59) | 1019.2 (17.84) |
| Tensile Strength, lbs. | 8.12 (.27) | 6.78 (.19) | 8.94 (.51) | 10.72 (.54) |

-continued

| EXAMPLE PROPERTY | A | 1 | 2 | 3 |
|---|---|---|---|---|
| Tenacity, gpd | 4.96 (.16) | 4.86 (.14) | 4.97 (.28) | 4.76 (.24) |
| Elongation @ Break, % | 51.44 (4.34) | 54.87 (3.55) | 48.43 (3.61) | 48.29 (6.13) |
| Elongation @ 1.75 gpd, % | 14.21 (.11) | 15.17 (.93) | 12.66 (.63) | 13.44 (.39) |
| Elongation @ 3.0 gpd, % | 26.94 (.12) | 28.61 (1.21) | 24.26 (.85) | 25.41 (.55) |
| Initial Modulus, gpd | 68.05 (.23) | 64.76 (1.89) | 68.54 (3.99) | 65.48 (2.21) |
| Sandpaper Abrasion-Dry (Cycles, Load = 250 g) | 153 (13.52) | 84 (15.41) | 154 (23.05) | 234 (22.80) |
| Sandpaper Abrasion-Wet (Cycles, Load = 250 g) | 111 (15.98) | 107 (10.59) | 163 (10.24) | 204 (27.73) |
| Squirrel Cage Abrasion-Dry (Cycles, Load = 250 g) | 14355 (4347.0) | 10018 (3290.3) | 16409 (4150.9) | 16541 (3548.1) |
| Squirrel Cage Abrasion-Wet (Cycles, Load - 250 g) | 18056 (7625.5) | 13962 (2478.9) | 17690 (4351.0) | 18348 (4436.2) |
| Surface Energy, Dynes/cm | | | | |
| Initial no wet | — | 31 | 33 | 34 |
| Final no wet | 37 | 38 | 44 | 42 |

I claim:

1. A polymeric monofilament having a diameter of about from 4 to 60 mils and having a cross-sectional configuration characterized by 3 to 12 striations on the circumference, each striation having a depth of about from 4 to 20% of the diameter of the monofilament.

2. A monofilament of claim 1 having a diameter of about from 6 to 30 mils.

3. A monofilament of claim 1 having from 5 to 10 striations.

4. A monofilament of claim 1 wherein the striations have a depth of about from 8 to 15% of the diameter of the monofilament.

5. A monofilament of claim 1 consisting essentially of polyamide.

6. A monofilament of claim 5 wherein the polyamide is selected from the group consisting of nylon 66, nylon 610 and nylon 6.

7. A monofilament of claim 6 wherein the polyamide consists essentially of nylon 66.

8. A monofilament of claim 1 consisting essentially of polyester.

9. A monofilament of claim 8 wherein the polyester consists essentially of polyethylene terephthalate.

10. A monofilament of claim 3 having 8 circumferential striations.

11. In a woven, heat set, papermaking belt of machine and transverse direction thermoplastic filaments, the improvement wherein at least 20% of the filaments in at least one of the machine and cross machine directions are polymeric monofilaments having a cross-sectional configuration characterized by 3 to 12 striations on the circumference, each striation having a depth of about 4 to 20% of the diameter of the monofilament.

12. The papermaking belt of claim 11 wherein the diameter of the monofilament is about from 4 to 60 mils.

13. The papermaking belt of claim 11 wherein the diameter of the monofilament is from 6 to 30 mils.

14. The papermaking belt of claim 11 wherein the monofilament has 5 to 10 striations.

15. The papermaking belt of claim 11 wherein the striations have depth of from 8 to 15% of the diameter of the monofilament.

16. The papermaking belt of claim 11 wherein the monofilaments consist essentially of a polyamide.

17. The papermaking belt of claim 16 wherein the polyamide is selected from the group consisting of nylon 66, nylon 610 and nylon 6.

18. The papermaking belt of claim 17 wherein the polyamide is nylon 66.

19. The papermaking belt of claim 11 wherein the monofilaments consist essentially of a polyester.

20. The papermaking belt of claim 19 wherein the polyester is polyethylene terephthalate.

21. The papermaking belt of claim 14 wherein there are 8 striations on the circumference of the monofilaments.

22. The papermaking belt of claim 11 wherein the monofilaments comprise from 50 to 100% of either or both of the machine or cross machine direction strands.

* * * * *

UNITED STATES PATENT AND TRADEMARK OFFICE

CERTIFICATE OF CORRECTION

PATENT NO. : 6,352,772 B1
DATED : March 5, 2002
INVENTOR(S) : Robert A. Keller

It is certified that error appears in the above-identified patent and that said Letters Patent is hereby corrected as shown below:

Column 4,
Lines 55-57, cancel claims 1-10.
Line 65, after "monofilament" add, -- being substantially arcuate in configuration and beginning and ending at a point on the circumference --

Signed and Sealed this

Twenty-fifth Day of March, 2003

JAMES E. ROGAN
*Director of the United States Patent and Trademark Office*